US007408837B2

(12) United States Patent
Harvey

(10) Patent No.: US 7,408,837 B2
(45) Date of Patent: Aug. 5, 2008

(54) MEASUREMENT WHILE DRILLING TOOL AND METHOD

(75) Inventor: Peter R. Harvey, Tampa, FL (US)

(73) Assignee: Navigate Energy Services, LLC, Youngsville, LA (US)

( * ) Notice: Subject to any disclaimer, the term of this patent is extended or adjusted under 35 U.S.C. 154(b) by 290 days.

(21) Appl. No.: 11/406,883

(22) Filed: Apr. 19, 2006

(65) Prior Publication Data

US 2007/0258327 A1 Nov. 8, 2007

(51) Int. Cl.
*E21B 47/18* (2006.01)

(52) U.S. Cl. ..... 367/85; 367/83; 166/386; 175/40

(58) Field of Classification Search ..... 367/83, 367/85; 166/321, 386; 175/40, 50; 417/505
See application file for complete search history.

(56) References Cited

U.S. PATENT DOCUMENTS 3,958,217 A 5/1976 Spinnler
4,386,422 A * 5/1983 Mumby et al. ..... 367/85
4,825,421 A 4/1989 Jeter
4,839,870 A 6/1989 Scherbatskoy
5,333,686 A 8/1994 Vaughan et al.
5,473,579 A 12/1995 Jeter
5,586,084 A 12/1996 Barron et al.
6,898,150 B2 5/2005 Hahn et al.
2005/0045344 A1 * 3/2005 Fraser et al. ..... 166/386
2005/0260089 A1 * 11/2005 Hahn et al. ..... 417/505

* cited by examiner

*Primary Examiner*—Timothy Edwards, Jr.
(74) *Attorney, Agent, or Firm*—Robert L. Waddell; Ted M. Anthony

(57) ABSTRACT

An apparatus for telemetering a downhole parameter from a well. The apparatus comprises a housing having a bore. The apparatus further comprises an annular main valve with an enlarged end positioned within the bore, with the main valve having a center of axis. A restrictor is concentrically disposed within the bore, the restrictor configured to define an annular passage with the main valve. The apparatus also includes: a pressure device for supplying hydraulic pressure to the main valve; a control valve, operatively associated with the restrictor member, for controlling pressure to the main valve; and a solenoid control valve assembly for activating the control valve. In one preferred embodiment, the solenoid control valve assembly comprises a controller for emitting an electrical signal, a coil that receives the electrical signal and generates a magnetic field, a solenoid static pole receptive to the generated magnetic field, and a solenoid moving pole responsive to the magnetic field so that the solenoid moving pole moves in a direction towards the solenoid static pole. A method for communicating a downhole parameter is also disclosed.

20 Claims, 8 Drawing Sheets

MEASUREMENT WHILE DRILLING TOOL AND METHOD

BACKGROUND OF THE INVENTION

This invention relates to a measurement while drilling tool. More specifically, but without limitation, this invention relates to an apparatus and method for telemetering a down hole parameter from a well.

Operators drill wells many thousands of feet in the search for hydrocarbons. The wells are expensive and take a significant amount of time to plan. Operators find it important to obtain data about the various subterranean reservoirs once the actual drilling begins. Thus, measurement while drilling (MWD) tools have been developed that gather information about the subterranean reservoirs and telemetry the data to the surface. Engineers and geologist can then use this data in an effort to understand the formations and make plans on completion, sidetracking, abandoning, further drilling etc.

MWD tools are expensive tools due to their complexity. The tools are designed for a lifetime of 5-7 years, and the tools are routinely made of expensive materials and electronics which require a lot of maintenance by highly trained personnel. Typically, service companies have geographically positioned regional maintenance facilities that perform these tasks. As the use of MWD and LWD tools expanded, several problems have become evident. One problem is that maintenance requires very high levels of training. Mean time between failures (MTBF) has become the standard measurement for evaluating the reliability of the MWD technology, and a central question is when will the tool fail. Another problem is that the maintenance facilities require large spaces and expensive testing equipment. It is not uncommon for a MWD tool to spend as much time traveling to and from these maintenance facilities as it does at the wellsite. In one study, it was found that a MWD tool string spends less than 90 days a year in a well, and the maintenance and logistics cost of a MWD tool can amount to 50% of the annual expense of the system.

Therefore, it is an object of the present invention to reduce the maintenance and repair time of MWD tools. It is also an object of the present invention to reduce the maintenance and repair cost. It is also an object to manufacture a tool that is less expensive to build, less complex and have higher reliability. These objects, and many others, will be met by the following disclosure.

SUMMARY OF THE INVENTION

An apparatus for telemetering a down hole parameter from a well is disclosed. The apparatus comprises a cylindrical housing having a bore there through. The apparatus further comprises an annular main valve positioned within the bore, with the main valve having a center of axis, and wherein the main valve is in a funnel shape having a tubular inlet and tubular outlet, and a restrictor member concentrically disposed within the bore of the cylindrical housing, wherein the restrictor member is aligned with the center of axis, the restrictor member configured to define an annular passage with the main valve. The apparatus also includes: a hydraulic circuit control pressure passage means for supplying hydraulic pressure to the main valve; control means, operatively associated with the restrictor member, for controlling pressure to the main valve; and a solenoid control valve assembly for activating the control means. It should be noted that the solenoid control valve assembly may also be referred to as the magnetic control valve assembly.

In one preferred embodiment, the solenoid control valve assembly comprises a controller for emitting an electrical signal, a coil receiving the electrical signal in order to energize the coil and generating a magnetic field, a solenoid static pole receptive to the generated magnetic field, and a solenoid moving pole responsive to the magnetic field so that the solenoid moving pole moves in a direction towards the solenoid static pole. Also, the control means may comprise a shaft operatively associated with the solenoid moving pole, a ball engageable with the shaft, and a ball seat configured to sealingly engage with the ball. The restrictor member may include a restrictor housing having a bolt that is selectively movable within the restrictor housing to vary the size of the annular passage. The restrictor housing further includes an annular screen for allowing passage of a fluid into an annular cavity.

The cylindrical housing is configured to have an annular flow area for the hydraulic circuit control passage means that communicates pressure from the pressure means to the main valve through the cylindrical housing. In one preferred embodiment, the hydraulic circuit control passage means includes a passage through said static pole and through the ball seat in order to act against the main valve. Additionally, as the coil de-energizes, the shaft, via the moving pole, returns and the ball is allowed to return to seal against the ball seat so that the main valve moves from a first position to a second position thereby enlarging the annular passage.

A method of communicating a down hole parameter is also disclosed. The method comprises providing a down hole apparatus, the down hole apparatus including: a cylindrical housing having a bore; an annular main valve positioned within the bore, the main valve having a center of axis, and wherein the main valve has a first end disposed within the bore and an enlarged second end, and wherein the main valve is movable from a first position to a second position; a restrictor member concentrically disposed within the bore of the enlarged second end of the main valve, wherein the restrictor member being aligned with the center of axis, and wherein the main valve has the first end disposed within the bore and the enlarged second end configured to form an annular passage about the restrictor member; hydraulic circuit control pressure passage means for supplying hydraulic pressure to the main valve.

The method further includes flowing the drilling fluid through the bore, emitting an electrical signal with a controller, and receiving the electrical signal with a coil. The method further includes generating a magnetic field, receiving the magnetic field at a solenoid static pole so that the solenoid static pole is magnetized, and moving a solenoid moving pole in response to the generated magnetic field in the direction of the solenoid static pole. The method further includes moving a shaft, the shaft being operatively attached to the solenoid moving pole. The method further comprises displacing a ball that is seated within a ball seat, allowing pressure from an annular cavity to pass through a hydraulic circuit control pressure passage means which includes through the ball seat and displace the main valve from the first position to the second position, and decreasing the annular passage between the main valve and the restrictor member thereby causing a pressure pulse to be created within the bore of the cylindrical housing indicative of the downhole parameter.

In one preferred embodiment, the step of flowing the drilling fluid through the bore includes channeling the turbulent flow of the drilling fluid through the enlarged second end of the main valve and into the annular passage. The method may further comprise emitting a second electrical impulse signal with the controller, terminating the second electrical signal to the coil so that the magnetic field is terminated, moving the ball onto the ball seat by the pressure within the annular cavity via the pressure within the cavity, terminating the flow through the hydraulic circuit control pressure passage means and moving the main valve from the second position to the first position via the pressure within the bore of the cylindrical housing.

An advantage of the present invention is that the design allows for fewer parts and a shorter tool length. Another advantage is that the components of the system are designed in modules, wherein the modules can be replaced with a new module. Another advantage is that no field service technicians are needed, eliminating maintenance problems. Because the tool is designed to go straight from manufacturing to the rig, much higher utilization rates will be achieved.

A feature of the present invention includes the annular main valve, wherein the funnel shape of the main valve contains all violent, turbulent flow caused by pulsers, and in doing so, it contains all the erosion within its surface that is made of very hard ceramic or tungsten carbide material. Another feature is the ball control valve that utilizes a poppet valve constructed of a separate ball and shaft that allows the ball to seat perfectly by eliminating concentricity issues. Another feature is that the present design is very well suited for fluids with high solid contents.

Yet another feature is the annular screen element that allows a large inlet area for a relatively small axial height, thus allowing the overall length to be significantly shorter than current designs. Still yet another feature is that the annular solenoid doughnut shape provides the geometry best suited to minimize overall valve length. Another feature is the annular control valve. Still yet another feature is the control valve ball seat, pilot driven main valve, and exit that are nearly aligned to minimize axial packaging requirements. Thus, the shortest (minimum axial length) possible valve is obtained.

DETAILED DESCRIPTION OF THE PREFERRED EMBODIMENTS

Figure 1B:
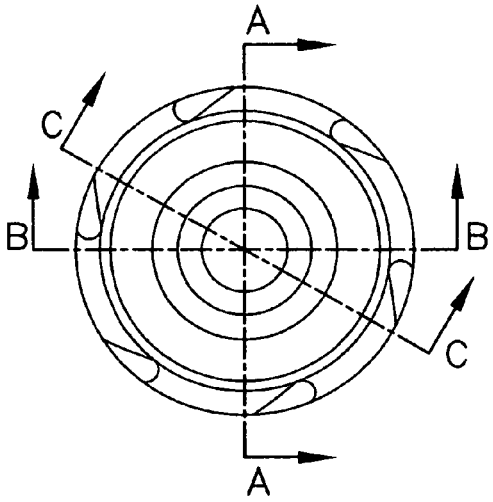
FIG. 1B is a perspective view of the drill bit and drill collar housing seen in FIG. 1A taken from view I-I.
Figure 1A:
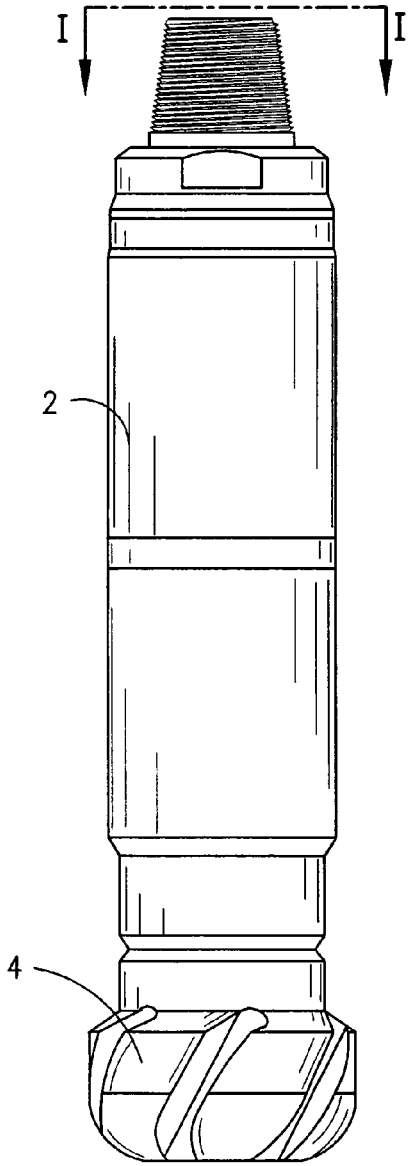
FIG. 1A is a perspective view of the drill collar housing containing the down hole apparatus and drill bit.

Referring now to FIG. 1A, a perspective view of the drill collar housing 2 containing the down hole apparatus and drill bit 4. As understood by those of ordinary skill in the art, the drill collar housing 2 is connected to the drill bit 4. FIG. 1B is a perspective view of the drill collar housing seen in FIG. 1A taken from view I-I. More specifically, FIG. 1B depicts the lines A-A, B-B, and C-C which will described in more detail later in the application.

Figure 2:
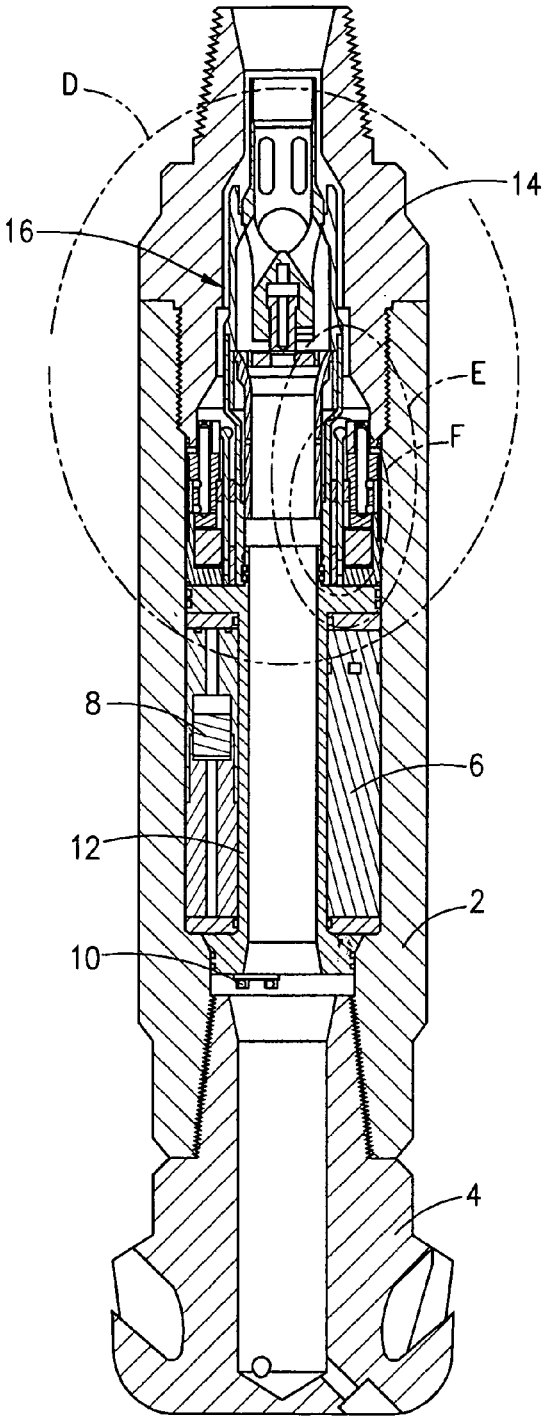
FIG. 2 is a cross-sectional view of the drill collar housing containing the down hole apparatus seen in FIG. 1A taken along line A-A of FIG. 1B.

Referring now to FIG. 2, a cross-sectional view of the drill collar housing containing the down hole apparatus, drill collar housing 2 and drill bit 4 seen in FIG. 1A taken along line A-A of FIG. 1B will now be described. It should be noted that like numbers appearing in the various drawings refer to like components. More specifically, FIG. 2 depicts the battery and electronics section 6 to power and control the tool. The electronics section 6 includes a controller for processing collected down hole data, storing the data and generating outputs to the various electronic components. FIG. 2 also depicts the sensors 8 to make measurements, such as directional survey sensors and/or gamma ray sensors. A communications port 10 is provided in order to talk to the tool before and after being used in the drill string. The pressure housing 12 is shown, wherein the pressure housing 12 is used to package sensors, batteries, and electronics. FIG. 2 also depicts the drill collar housing 14 that connects to the remainder of the drill string. FIG. 2 also depicts the detail ovals D, E and F which will be discussed later in the application. The down hole pulser apparatus is seen generally at 16, and is generally contained within the detail box D.

Figure 3:
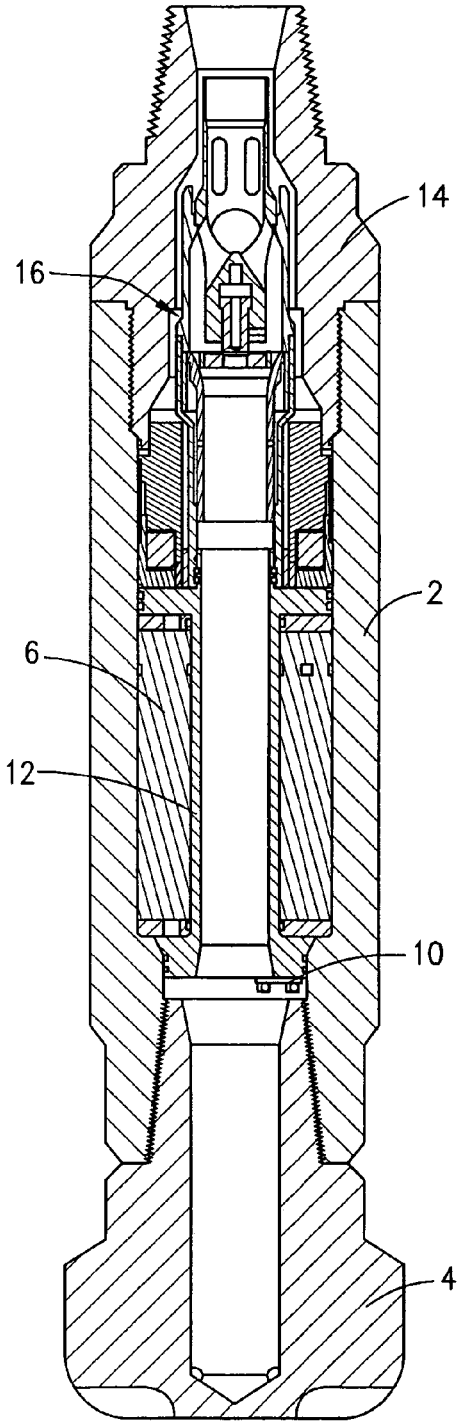
FIG. 3 is a cross-sectional view of the drill collar housing containing the down hole apparatus seen in FIG. 1A taken along line B-B of FIG. 1B.

FIG. 3 is a cross-sectional view of the drill collar housing 2 taken along line B-B of FIG. 1B. FIG. 3 depicts the battery and electronics section 6, the pressure housing 12 and the communications port 10, as well as the downhole pulser apparatus 16 (hereinafter pulser 16).

Figure 4B:
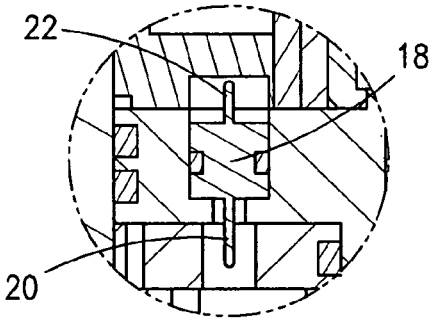
FIG. 4B is an enlarged view of the pressure bulkhead seen in FIG. 4A.
Figure 4A:
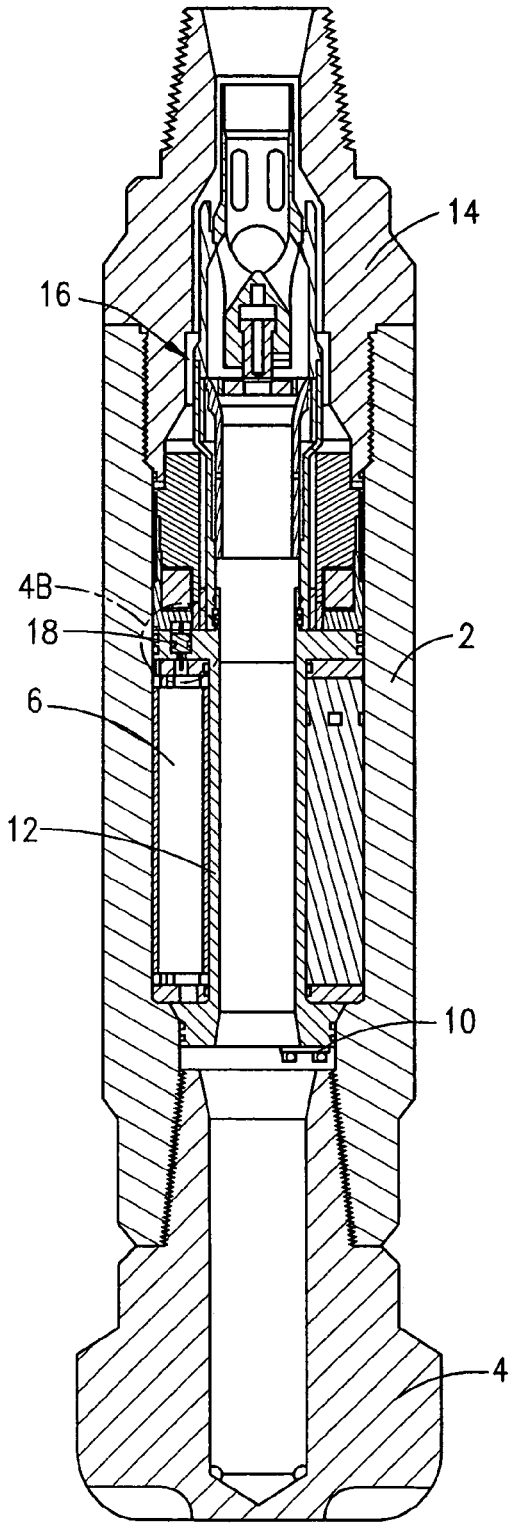
FIG. 4A is a cross-sectional view of the drill collar housing containing the down hole apparatus seen in FIG. 1A taken along line C-C of FIG. 1B.

FIG. 4A is a cross-sectional view of the drill collar housing 2 containing the pulser 16 taken along line C-C of FIG. 1B. The pressure bulkhead 18 is also shown in FIG. 4A. FIG. 4B is an enlarged view of the pressure bulkhead 18 seen in FIG. 4A. The pressure bulkhead 18 is used to provide electrical power to the solenoid, but isolate internals of the pressure housing 12 from fluid pressure exposure. The pressure bulkhead 18 contains a single conductor with first prong 20 that is connected to the battery and electronic section 6 and a second prong 22 that connects to the solenoid coil that will be described in greater detail later in the application. There are two pressure bulkheads 18 (one is not shown), one for each electrical termination of the solenoid coil.

Figure 5:
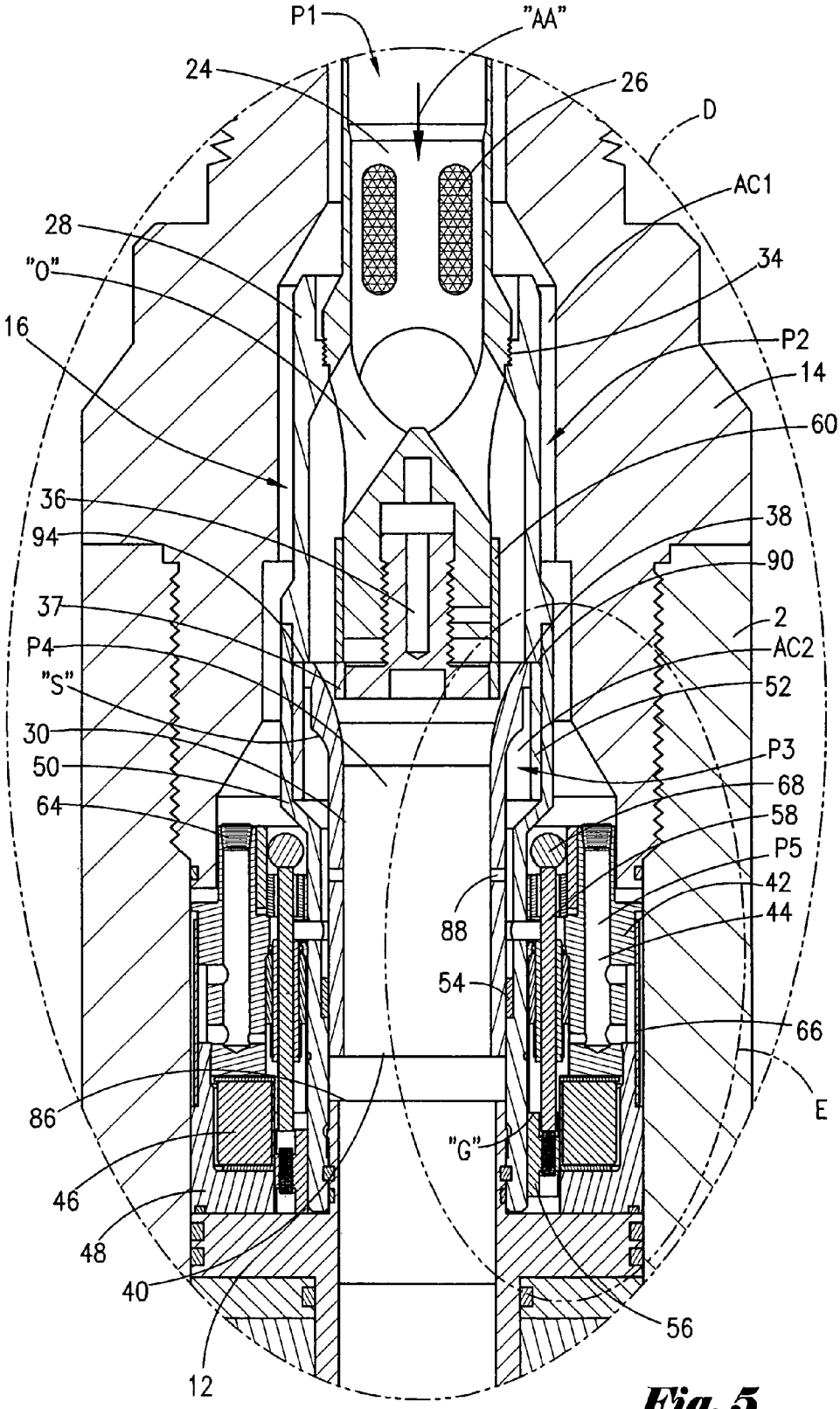
FIG. 5 is an enlarged view of the detail area "D" seen in FIG. 2.

Referring now to FIG. 5, an enlarged view of the detail area "D" as seen in FIG. 2, and in particular the pulser 16 seen in FIG. 2, will now be described. FIG. 5 depicts the screen and restrictor housing 24 with the annular screen 26 disposed therein. As those of ordinary skill in the art recognize, the drilling fluid is pumped down the drill string, as denoted by arrow "AA". The screen 26 allows the liquid part of the drilling fluid flow to pass and keeps the larger particles from going into the hydraulic circuit control passage and the solenoid control valve assembly, as will be more fully described later. FIG. 5 also depicts the annular control housing 28 which provides the large annular area for the hydraulic circuit control passage that feeds the main valve 30 with drilling fluid, as will be more fully explained. The main valve 30 contains an outer diameter portion and an inner diameter portion. FIG. 5 shows the connection point of the screen 26 and restrictor housing 24 and the annular control housing 28 at threads 34.

FIG. 5 further depicts the restrictor bolt 36 which supports the main valve restrictor 37 and provides a means to adjust the axial position used to set the size of the pressure pulse. As seen in FIG. 5, the main valve 30 is in a funnel shape. In other words, the first end 38 has a larger inner diameter than the second end 40, and wherein end 38 acts as a tubular inlet and end 40 acts as a tubular outlet for the drilling fluid.

The restrictor housing 24 holds the restrictor 37 and screen 26 and provides a passage for the drilling fluid from the center of the drill pipe to the annulus cavity between the restrictor 37 and the main valve 30. The restrictor 37 provides the restriction on the inner conical surface of the main valve for the flow of the drilling fluid. If the main valve 30 moves forward enough, the main valve 30 could contact the restrictor 37 and completely shut off the flow of the drilling fluid. In the embodiment shown, however, this could not happen because there is a physical stop upstream of the main valve that stops it from contacting the restrictor. As will be more fully explained later in the application, the solenoid control valve assembly opens and closes and causes flow or no flow through the hydraulic circuit control passage. The restrictor 37 will be attached to the annular control housing 28 as shown in FIG. 5. The drilling fluid coming down the bore of the drill pipe will divert about the diverter, out of the opening "O", and back into the bore of the main valve 30.

Figure 8:
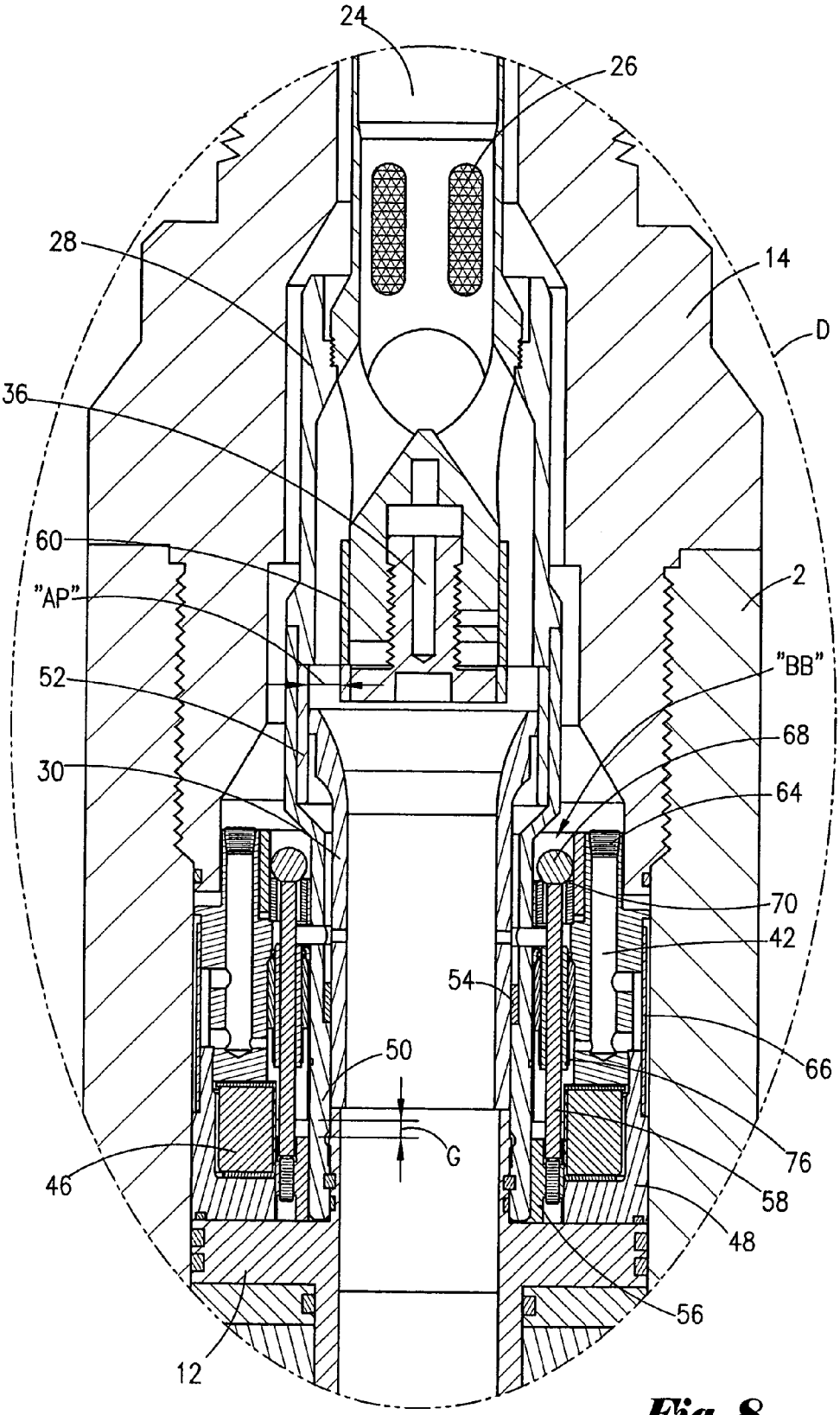
FIG. 8 is an enlarged view of the detail area "D" seen in FIG. 2.

FIG. 5 further depicts the solenoid control valve assembly which includes the solenoid static pole 42, and wherein the solenoid static pole 42 contains certain cavities, seen generally at 44 that contain hydraulic oil. The solenoid static pole 42 is operatively associated with the solenoid coil 46, and wherein the solenoid coil 46 is connected to the solenoid coil housing 48. As shown in FIG. 5, the solenoid coil housing 48 is positioned within the drill collar housing 2. The pulser 16 also includes the main valve bearing housing 50, and wherein the main valve bearing housing 50 is operatively connected to the annular control housing 28. The main valve upper bearing 52 and the main valve lower bearing 54 are adjacent and cooperate with the main valve bearing housing 50, and wherein the bearings 52 and 54 serve the purpose of positioning the main valve 30 concentric within the main valve bearing housing 50. The solenoid moving pole 56 is shown disposed between the main valve bearing housing 50 and the poppet shaft 58. The solenoid coil 46 is the winding that when current flows through it, it creates a magnetic field in the iron-rich materials that form a path around the coil 46. The magnetic field produces a magnetic force that attracts the solenoid moving pole 56 to the solenoid static pole 42. As seen in FIG. 8, lack of this force causes the axial gap "G" to open.

Returning to FIG. 5, the restrictor sleeve 60 covers the axial gap between the restrictor 37 and the restrictor bolt 36. The restrictor 37 is made of very hard material such as ceramic or tungsten carbide. Also, FIG. 5 depicts the pressure pipe plug 64 that is used to fill and isolate the control valve cavity 44 which is filled with clean hydraulic fluid. The rubber compensating sleeve 66 compensates for hydraulic fluid contraction and expansion within cavity 44 due to temperature and pressure.

It should be noted that as shown in FIG. 5, the most preferred embodiment depicts a ball on the left side and the right side as well as a shaft on the left side and the right side that are attached to one moving pole (which is cylindrical). Only the right side ball and shaft have been described.

Figure 6:
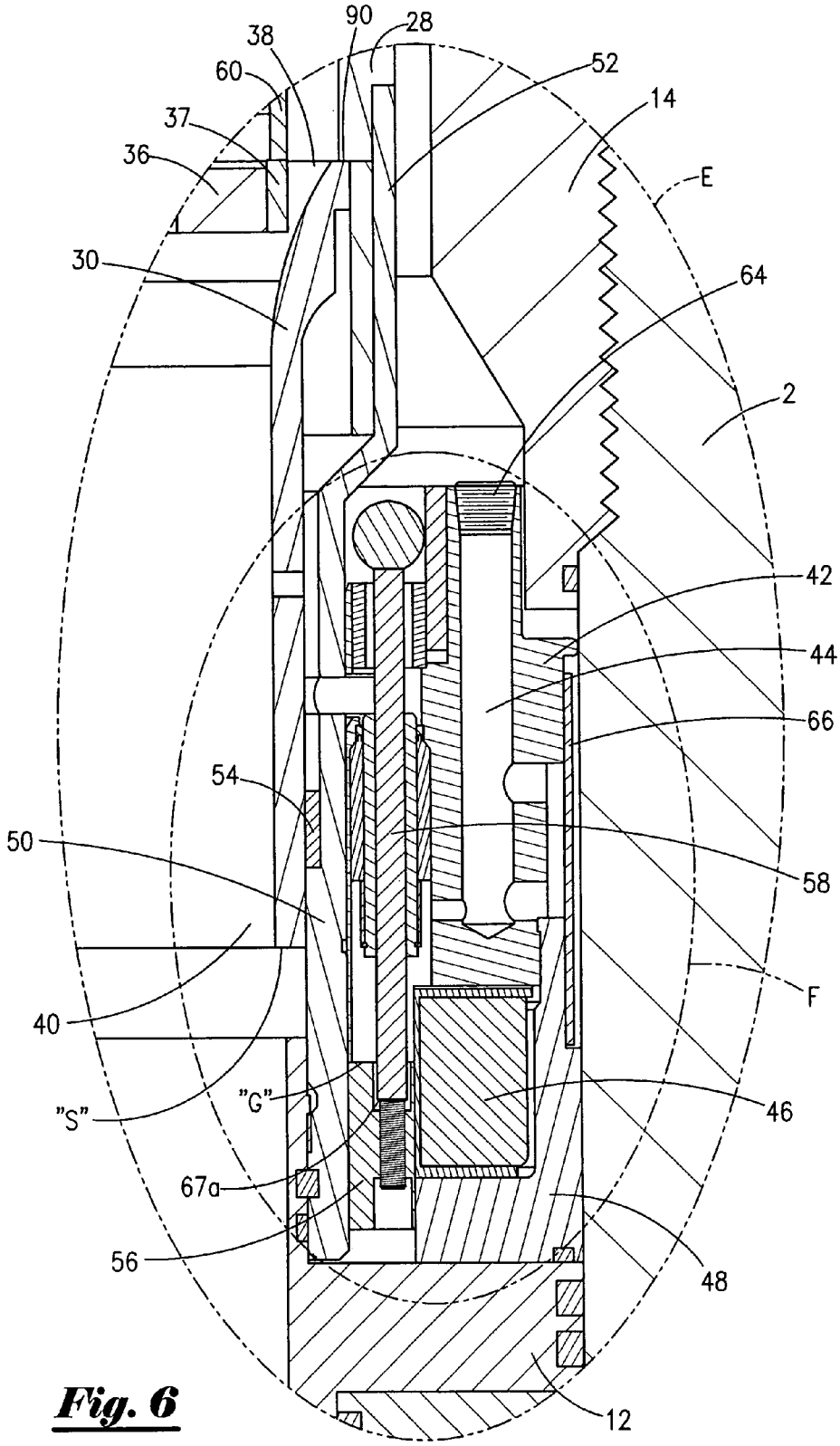
FIG. 6 is an enlarged view of the detail area "E" seen in FIG. 2.

Referring now to FIG. 6, an enlarged view of the detail area "E" seen in FIG. 2 will now be described. This view shows, among other things, the main valve bearing housing 50, and slidably adjacent to it, the solenoid moving pole 56. The main valve bearing 54 is disposed between the main valve 30 and the main valve bearing housing 50. FIG. 6 also depicts the cavity 44. The first end 38 of main valve 30 depicts the enlarged inner diameter while the second end 40 depicts the smaller inner diameter. Thus, main valve 30 is in the shape of a funnel. The shaft 58 has a bottom 67*a* that will engage with the top end of the set screw as will be explained later in the application.

Figure 7:
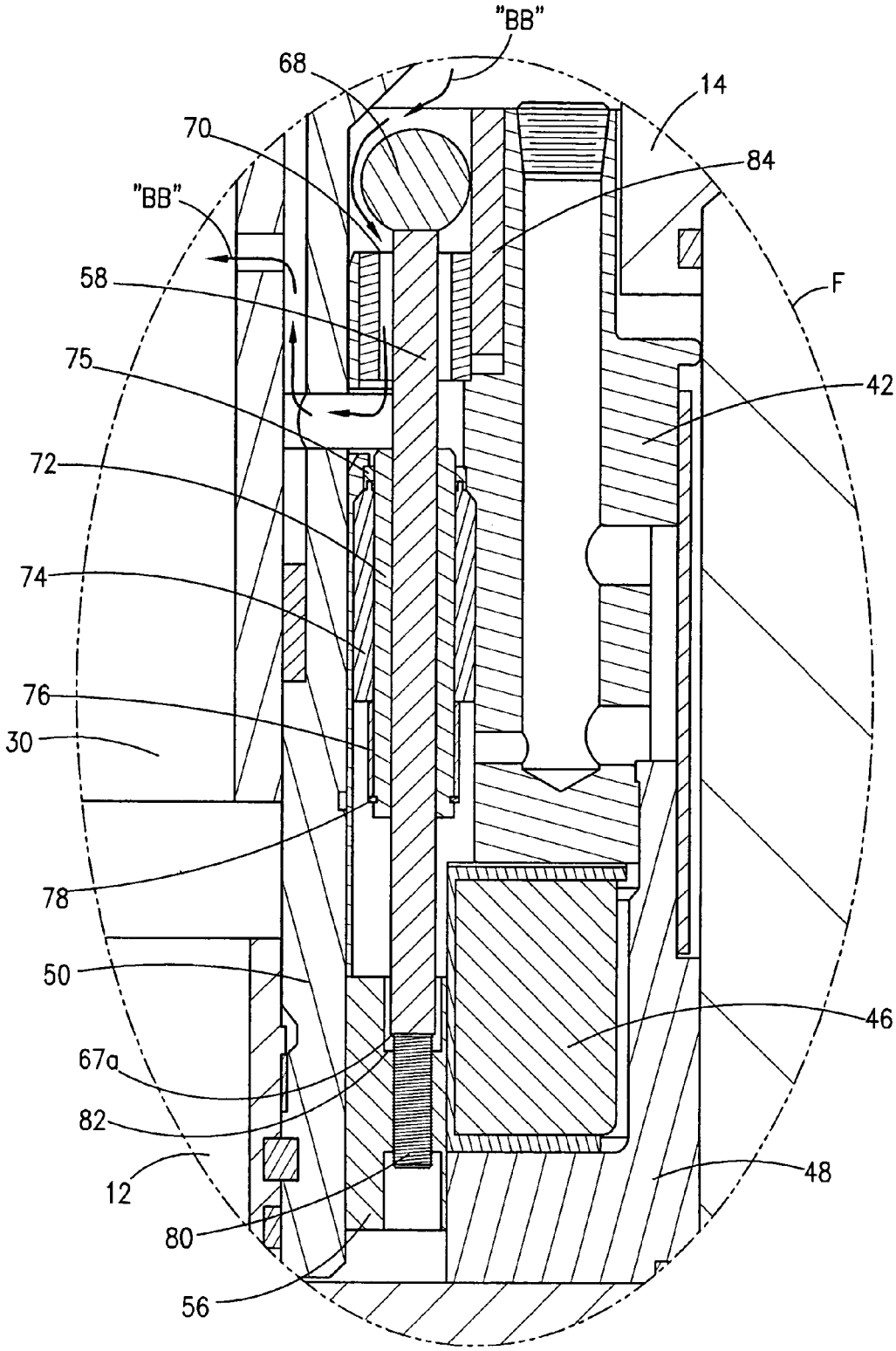
FIG. 7 is an enlarged view of the detail area "F" seen in FIG. 6.

FIG. 7 is an enlarged view of the detail area "F" seen in FIG. 6. The control valve ball 68 is positioned adjacent the control valve poppet shaft 58, and wherein the ball 68 is separate from shaft 58 and the ball 68 will seal-off in the seat 70. A control valve shaft sleeve 72 is pressed onto the control valve poppet shaft 58, and the control valve poppet bearing 74 is disposed about sleeve 72. A control valve wiper and seal 75 is also included. The control valve return spring 76 pushes the moving pole 56 back into its lower position when the current in the solenoid is removed and the magnetic field is turned off. The spring 76 engages the retaining ring 78. The setscrew 80 is used to adjust the critical gap of the solenoid that defines how far the ball 68 moves. The set screw 80 that is threaded into the moving pole will engage with the bottom 67*a* of the shaft 58 so that movement of the moving pole 56 moves the set screw 80 which in turn engages and moves the shaft 58.

As seen in FIG. 7, the control valve ball guide rails 84 contain the control valve ball 68 by providing for a large unobstructed inlet flow area when the ball is unseated. The arrows "BB" depicts the hydraulic circuit control passageway which allows the pressure to act against the main valve 30.

It should be noted that FIGS. 5, 6, 7 show the situation where the shaft 58 has displaced the ball 68 due to the magnetic movement means, and in particular, the solenoid moving pole 56. As noted earlier, the shoulder 67*a* is engaged with moving pole 56 which causes shaft 58 to move upward. FIG. 8 is an enlarged view of the detail area "D" seen in FIG. 2. In FIG. 8, the ball has resumed its position on the control valve seat 70 so that the hydraulic pressure is no longer communicated through the hydraulic circuit control pressure passage "BB" and against the main valve 30 (i.e. the hydraulic circuit control pressure passageway is closed), which is due to the termination of the magnetic field. In other words, in FIG. 8, the solenoid moving pole 56 has returned to its initial position. When the coil is de-energized, the control valve ball 68 seals against the seat 70, and the shaft 58 is in its lowered position due to the de-energized coil. The shaft 58 has returned to this lowered position due to the biasing action of spring 76. Hence, FIG. 8 depicts a view of the detail area "D" seen in FIG. 2, wherein the ball 68 is seated on the seat 70. The annular passage is denoted by the letters "AP".

Referring back to FIGS. 5, 6, and 7 collectively, the pressure profile within the pulser 16 will now be described. P1 denotes the pressure of the drill pipe fluid flow just upstream or at the inlet of the pulser 16. P2 is the pressure of the annular cavity AC1 filtered by the screen 26. P3 signifies the pressure of the annular cavity AC2 formed by the main valve 30. P4 is the pressure of the primary drilling fluid flow in the bore of the main valve 30 downstream from the restrictor 37. Also, P5 is the oil pressure of the internal cavities 44 of the solenoid control valve assembly.

According to the teachings of the present invention, there are two (2) states for the pulser 16. In the first state, there is no flow through the hydraulic circuit control passage "BB". The control valve ball 68 seals against the control valve ball seat 70 and prevents any flow through the hydraulic circuit control passage. The main valve 30 is pushed downstream against the mechanical stop 86 (seen expressly in FIG. 5). In this state, there is a minimum of pressure drop through the pulser 16. This minimum pressure drop, which has been found to be usually less than 100 psi, is the hydraulic power used to drive the main valve's 30 movement to the upward (restricted) position. The annular cavity AC2 of the main valve 30 has a pressure P3, which equals its bore pressure P4.

In the second state, there is flow through the hydraulic circuit control passage "BB". The flow goes through the screen 26, then past the control valve ball 68 and ball seat 70 and finally, through a hole 88 in the main valve 30. The opening area of the control valve ball 68 and ball seat 70 of the solenoid control valve assembly is much larger than the hole 88 through the main valve 30. When flow begins in the hydraulic circuit control passage "BB, there is a pressure increase in the annular cavity AC2 of the main valve, that is, P3 increases to the value of P2. That is, the annular pressure of the main valve 30 now experiences the upstream inlet pressure of the pulser 16. This pressure increase causes the main valve 30 to move forward. As the main valve 30 moves forward, it closes the distance (space) between the main valve 30 and the restrictor 37 (i.e. the area of the annular passage decreases). This increases the pressure drop across the tool and more specifically through the restriction between the restrictor 37 and the main valve 30. This causes a pressure pulse that travels at the speed of sound upstream to the drilling rig. The main valve 30 then stops movement as it hits the upstream physical stop 90, which is the radial end of the annular control housing 28.

In operation, the solenoid control valve assembly starts operation in the closed position (i.e. the first state). The control flow through the hydraulic circuit control passage "BB" is shut-off. The net pressure on the main valve 30 is biased downward and so the main valve 30 rest on the downstream stop 86. As understood by those of ordinary skill in the art, the electronics encode sensor data into pressure pulses. Also as well understood by those of ordinary skill in the art, there are many algorithms to encode the sensor data. When it is time to send a pulse, the electronics (controller) send the necessary current and voltage to the solenoid coil 46, which pulls in the moving pole 56 to stop against the static pole 42.

The moving pole 56 pushes the poppet shaft 58, which pushes the ball 68 off the sealing seat 70. As mentioned earlier, this allows a free flow through the hydraulic circuit control passage BB, which is through the screen 26, through the annular space AC1, through the ball seat 70, and past the poppet shaft 58, into the annular cavity AC2 of the main valve in order for the hydraulic pressure to act against the radial surface "S" (on the outer diameter portion of the main valve 30). This control flow is restricted through the small exit hole 88 of the main valve 30 resulting in the system pressure drop being experienced in the AC2. This flow provides an increase in pressure in the annular cavity AC2 of the main valve 30, which creates an imbalance and starts moving the main valve 30 upstream. This movement continues until the main valve 30 hits the up-hole physical stop 90. When the movement stops, there is a tighter restriction in the annular passage "AP" i.e. the flow area between the main valve 30 and the restrictor 37. This restriction causes an increase in pressure above the tool, which can be seen at the surface. After a short time interval (anywhere from 1/10 of a second or greater, depending on the code format), the electronics shuts off the current to the solenoid, which allows the moving pole 56 to return to its un-energized state using the spring force 76. This action shuts-off flow through the hydraulic circuit control passage "BB", since the ball 68 seats again on the seat 70. The system is again back to the original first state. The main valve 30 then returns to the original position due to the force of the drilling fluid moving down the drill string.

Figure 9:
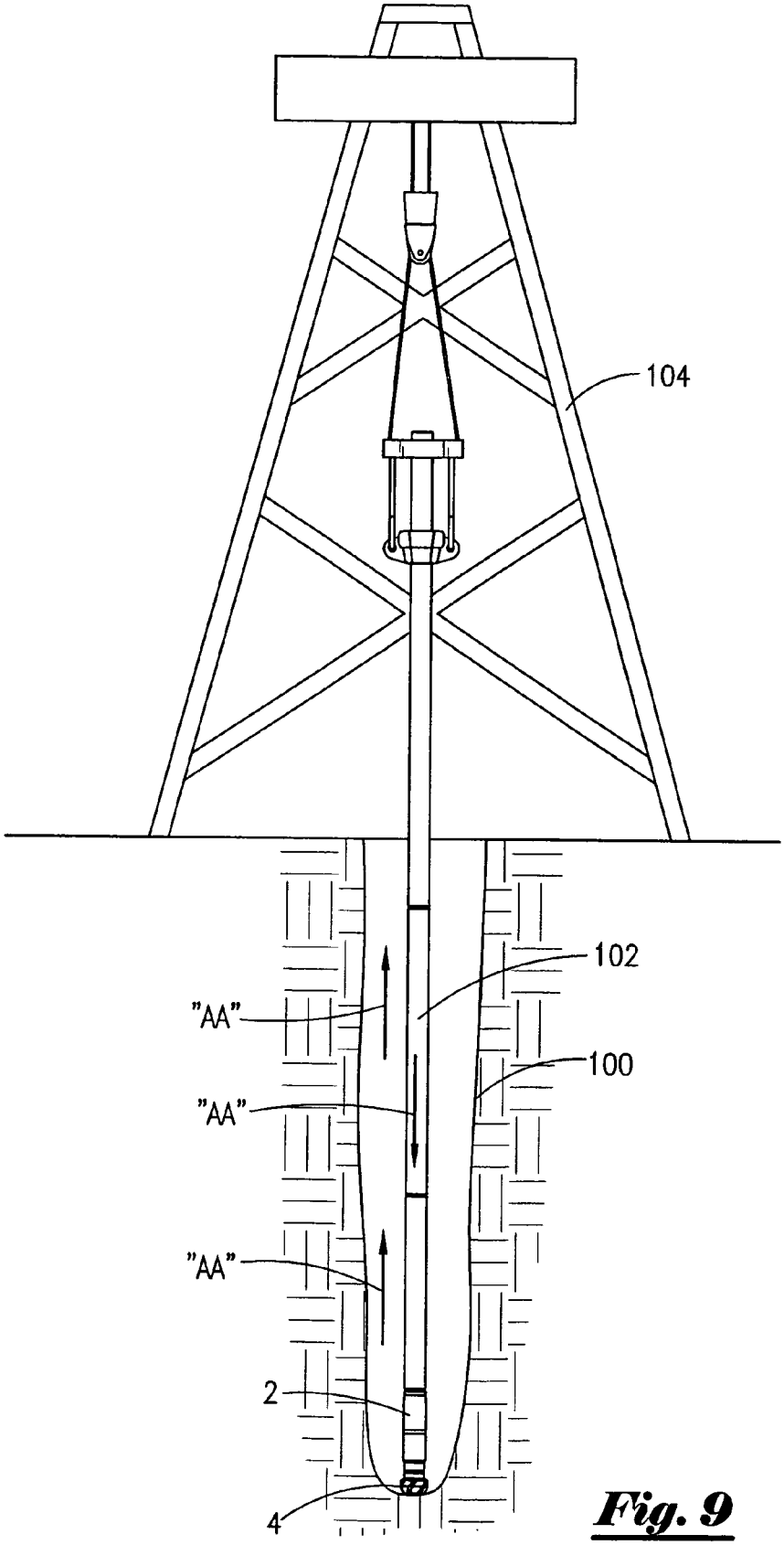
FIG. 9 is a schematic representation of the down hole apparatus being used in a well bore.

Referring now to FIG. 9, a schematic representation of the downhole apparatus being used in a well bore 100 will now be described. Hence, the bit 4, which is connected to the drill collar housing 2, has drilled the well bore 100, and the operator is performing measurement while drilling operations. A drill string 102 is attached at one end to the rig 104 and at the other end is connected to the drill collar housing 2 (as noted earlier, the down hole apparatus 16 is positioned within the drill collar housing). The fluid flow of the drilling fluid within the well bore 100 is shown by the arrows "AA", which is known as circulating. As taught by the present disclosure, the downhole sensors are collecting data, and the data is being processed down hole, and ultimately, the information is telemetered via pressure pulses through the fluid column to the surface.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. An apparatus for telemetering a down hole parameter from a well, the apparatus comprising:

a cylindrical housing having a bore there through;

an annular main valve positioned within the bore, said main valve having a center of axis, and wherein said main valve is in a funnel shape having a tubular inlet and a tubular outlet;

a restrictor member concentrically disposed within the bore of said cylindrical housing, said restrictor member being connected to said cylindrical housing, wherein said restrictor member being aligned with said center of axis, said restrictor member configured to define an annular passage with said main valve;

a hydraulic circuit control pressure passage means for supplying hydraulic pressure to said main valve;

control means, operatively associated with said restrictor member, for controlling pressure to the main valve;

solenoid control valve assembly for activating said control means.

2. The apparatus of claim 1 wherein said solenoid control valve assembly comprises:

controller for emitting an electrical signal;

coil receiving said electrical signal in order to energize said coil and generating a magnetic field;

solenoid static pole receptive to the generated magnetic field;

solenoid moving pole responsive to the magnetic field so that said solenoid moving pole moves in a direction towards said solenoid static pole.

3. The apparatus of claim 2 wherein said control means comprises:

a shaft operatively associated with said solenoid moving pole;

a ball engageable with said shaft;

a ball seat configured to sealingly engage with the ball.

4. The apparatus of claim 3 wherein said restrictor member includes a restrictor housing, having a bolt that is selectively movable within said restrictor housing to vary the size of the annular passage.

5. The apparatus of claim 4 wherein said restrictor housing further includes an annular screen for allowing passage of a fluid there through.

6. The apparatus of claim 5 wherein said main valve includes a radial surface, and wherein the hydraulic pressure of the drilling fluid acts against said radial surface via said hydraulic circuit pressure passage.

7. The apparatus of claim 6 wherein said hydraulic circuit control passage includes a path through said static pole and pass said ball seat in order for the hydraulic pressure to act against said main valve.

8. The apparatus of claim 7 wherein said controller terminates said electrical signal to said coil so that said coil de-energizes and wherein as said coil de-energizes, said shaft via the moving pole, returns and said ball is allowed to return to seal against the ball seat so that the main valve moves from a first position to a second position thereby enlarging the annular passage.

9. An apparatus for telemetering a down hole parameter from a well, the apparatus comprising:

a cylindrical housing having a bore there through, said cylindrical housing having a cavity therein;

an annular main valve positioned within the bore, said main valve having a center of axis, and wherein said main valve has a first end disposed within said bore and an enlarged second end, and wherein said main valve is movable from a first position to a second position and wherein said first end comprises a tubular inlet and said second end comprises a tubular outlet;

a restrictor member concentrically disposed within the bore of said enlarged second end of said main valve, wherein said restrictor member is attached to said cylindrical housing and being aligned with said center of axis;

a hydraulic circuit control passage means for supplying hydraulic pressure to said main valve;

a control valve, operatively associated with said restrictor member, for controlling pressure to the main valve;

a magnetic control valve assembly for activating said control valve in response to a measured down hole parameter.

10. The apparatus of claim 9 wherein said restrictor member being configured to define an annular passage with said main valve and wherein said restrictor member contains a diverter passageway so that flow through said annular passage diverts about an external portion of said restrictor member.

11. The apparatus of claim 10 wherein said magnetic control valve assembly comprises:

a controller for emitting an electrical signal in response to the measured down hole parameter;

a coil receiving said electrical signal, which energizes said coil and generates a magnetic field;

a magnetic static pole receptive to the generated magnetic field;

a magnetic moving pole responsive to the magnetic field so that said solenoid moving pole moves in a direction toward said magnetic static pole.

12. The apparatus of claim 11 wherein said control valve comprises:

a shaft operatively associated with said solenoid moving pole;

a ball engageable with said shaft;

a ball seat configured to sealingly engage with the ball.

13. The apparatus of claim 12 wherein said restrictor member includes a restrictor housing having a bolt selectively movable to vary size of the annular passage relative to said main valve.

14. The apparatus of claim 13 wherein said restrictor housing further includes an annular screen operatively associated with said restrictor housing for allowing passage of a fluid there through and into said hydraulic circuit control passage means.

15. The apparatus of claim 14 wherein said main valve includes a radial surface and wherein said hydraulic pressure of a drilling fluid acts against said radial surface via said hydraulic circuit control passage means.

16. The apparatus of claim 15 wherein said hydraulic circuit control passage means includes a path through said static pole and said ball seat in order to act against said radial surface of said main valve.

17. The apparatus of claim 16 wherein said controller terminates said electrical signal to said coil, said coil de-energizes, and wherein as said coil de-energizes, said shaft via the moving pole, returns and said ball is allowed to return to seal against the ball seat so that the pressure is no longer communicated to said hydraulic circuit control passage means and said main valve moves from the first position to the second position thereby enlarging the annular passage.

18. A method of communicating a down hole parameter, the method comprises:

providing a down hole apparatus, the down hole apparatus comprising: a cylindrical housing having a bore there through, said cylindrical housing having a cavity therein; an annular main valve positioned within the bore, said main valve having a center of axis, and wherein said main valve has a first end disposed within said bore and an enlarged second end, and wherein said main valve is movable from a first position to a second position; a restrictor member concentrically disposed within the bore of said enlarged second end of said main valve, wherein said restrictor member being aligned said center of axis, wherein said main valve has the first end disposed within the bore and the enlarged second end configured to form an annular passage about said restrictor member; hydraulic circuit control pressure passage means for supplying hydraulic pressure to said main valve;

flowing the drilling fluid through the bore;

emitting an electrical signal with a controller;

receiving the electrical signal with a coil;

generating a magnetic field;

receiving the magnetic field at a solenoid static pole so that the solenoid static pole is magnetized;

moving a solenoid moving pole in response to the generated magnetic field in the direction of the solenoid static pole;

moving a shaft, said shaft being operatively attached to said solenoid moving pole;

displacing a ball that is seated within a ball seat by the shaft;

allowing pressure from the cavity to pass through the hydraulic circuit control passage means located within said cylindrical housing, which includes a path through the ball seat;

allowing the pressure to act against a radial surface of said main valve;

displacing said main valve from the first position to the second position;

decreasing the area of the annular passage between said main valve and said restrictor member;

causing a pressure pulse to be created within the bore of said cylindrical housing indicative of the down hole parameter.

19. The method of claim 18 wherein the step of flowing the drilling fluid through the bore includes channeling the turbulent flow of the drilling fluid through the enlarged second end of the main valve and into the annular passage.

20. The method of claim 18 further comprising the steps:

terminating the electrical signal to the coil so that the magnetic field is terminated;

moving the ball onto the ball seat via the pressure within the cavity;

terminating the flow through the hydraulic circuit control passage means;

moving the main valve from the second position to the first position via the pressure within the bore of the cylindrical housing thereby increasing the area of the annular passage between said main valve and said restrictor member.

* * * * *